United States Patent [19]

Hühne et al.

[11] 4,201,341

[45] May 6, 1980

[54] DEVICE FOR AUTOMATIC DEPOSITING BY WELDING

[75] Inventors: Erwin D. Hühne, Schallstadt; Jochen H. Anders, Frankfurt am Main, both of Fed. Rep. of Germany

[73] Assignee: Castolin GmbH, Kriftel, Fed. Rep. of Germany

[21] Appl. No.: 926,290

[22] Filed: Jul. 20, 1978

[30] Foreign Application Priority Data

Jul. 22, 1977 [DE] Fed. Rep. of Germany ... 7722908[U]

[51] Int. Cl.[2] ..... B05B 13/02

[52] U.S. Cl. ..... 239/79; 118/47; 118/317; 239/227

[58] Field of Search ..... 239/79, 85, 227; 118/47, 306, 317

[56] References Cited

U.S. PATENT DOCUMENTS

| | | | |
|---|---|---|---|
| 3,917,170 | 11/1975 | Marino | 118/317 X |
| 4,013,518 | 3/1977 | Miko | 239/227 X |
| 4,106,760 | 8/1978 | Kono et al. | 118/317 X |

FOREIGN PATENT DOCUMENTS

| | | | |
|---|---|---|---|
| 1111995 | 7/1961 | Fed. Rep. of Germany | 239/79 |
| 7506296 | 2/1975 | Fed. Rep. of Germany . | |

*Primary Examiner*—Joseph E. Valenza
*Assistant Examiner*—Andres Kashnikow
*Attorney, Agent, or Firm*—Hopgood, Calimafde, Kalil, Blaustein and Lieberman

[57] ABSTRACT

An apparatus is provided for hard facing by powder flame spraying of inner surfaces of bores of relatively large workpieces difficult to mount rotatably, such as Diesel engine blocks, and the like. The apparatus comprises a stand, a carriage support pivotally and mounted to the stand via a holding mechanism coupled to the stand and adapted to be adjustably inclined and to move vertically between a pair of supporting columns of the stand. A carriage is mounted on the carriage support and has a burner assembly mounted to and extending transversely from the carriage, the burner assembly comprising a burner mounting having a longitudinal member extending therefrom through which powder flame spray material is fed, the member terminating into a nozzle disposed transverse to the longitudinal axis of the longitudinal member. The carriage is slidably mounted on the carriage support and has a mechanism associated therewith for sliding the carriage along the axis of the longitudinal member. The carriage also has a motor for rotating it about the axis of the longitudinal member via a bearing ring, the longitudinal member and the nozzle thereof rotating with the carriage, the bearing ring having guide rails cooperably associated with an eccentrically adjustable guide for indexing the burner assembly and carriage along the carriage support relative to a bore to be sprayed.

1 Claim, 5 Drawing Figures

DEVICE FOR AUTOMATIC DEPOSITING BY WELDING

The invention relates to apparatus for the automatic hard-facing of bore inside faces or the like on especially large workpieces which cannot be mounted rotatably, such as Diesel engine blocks or the like, by powder flame spraying with self-flowing or exothermally reacting powder alloys, consisting of a powder flame spraying burner, mounted movably on a stand, with powder and gas supply hose lines and an extension attachment which carries the powder and gas outlet nozzle.

Apparatus of this type is known from DT-GM 7 506 296. However, with this known apparatus the workpiece (sludge conveying screw) has to be turned and coating of the bore inside faces is consequently not possible.

For the hard-facing of workpieces of the above-mentioned type, hard-facing for the purpose of repair because of wear or in new production has hitherto been carried out in all occurring positions manually or mechanically by means of the so-called wire spraying method in which a rotating air nozzle rests on a wire supply device or on its extension attachment, at the free end of which the wire is fused. This air nozzle blows the fused welding material radially to the axis of the extension attachment against the face to be coated.

However, from the point of view of the adhesive tensile strength of the coated layer which is obtainable by means of a wire-shaped spraying addition material, this technique can be applied only to a limited extent, since when coated layers are highly stressed statically or dynamically the coated material peels off or shears off as a result of extreme inherent tension.

Substantially better technical values for adhesive and shearing strength are achieved with the so-called powder flame spraying techniques. These techniques differ from wire spraying in that the powdery hard-facing material is introduced into the flame of the burner by means of a gas flow conveyed at approximately 20 m/sec. Due to this conveying technique and the relatively high particle velocity, the possibility does not arise, as it does in wire spraying, of deflecting radially with compressed air the axially emerging spray jet, since in this case the spray particles would cool too strongly, which contributes to the generally poorer results for adhesive tensile strength in wire spray welding.

Apart from the fact that better hard-facing results can be achieved by means of the powder flame spraying method, the problem of the invention is to improve apparatus of the above-mentioned type so that it enables automatic hard-facing by powder flame spraying to be carried out especially on large workpieces which cannot be mounted directly rotatably.

This problem is solved according to the invention with apparatus of the above-mentioned type by the fact that the powder flame spraying burner is mounted on a motor-driven sliding carriage which is arranged, in turn, rotatably via a motor in a pivot mounting transversely to its sliding direction pointing towards the axis of the extension attachment and by the fact that the nozzle is arranged on the extension attachment inclined to perpendicular to the axis thereof.

With this design of the apparatus according to the invention it is possible, taking the coating of a bore inside face as an example, to move the spray nozzle on the extension attachment in tracks lying next to one another over the longitudinal extension of the bore, that is, to move it parallel to the axis thereof, the nozzle being shifted from track to track by means of the pivot mounting, optionally allowing for marginal overlapping of the coating tracks applied. For following coatings up to the desired layer thickness the apparatus is guided in the opposite direction of rotation or is turned back in the same direction for a new start, in order to prevent the supply hoses for the powder and gas from becoming twisted.

It is also possible, however, for the tracks to follow the curvature of the face to be coated and for the next track to be laid during or after reverse turning after a small step advance in the longitudinal direction, optionally allowing for overlapping of the tracks.

To enable the required spraying spacing from the coating face to be adjusted—spraying can only ever be carried out from a central position in wire spraying—the apparatus is advantageously designed so that the sliding carriage is arranged eccentrically within the pivot mounting.

A further advantageous form of the apparatus can consist in that the sliding carriage with its guide or the pivot mounting is mounted on the stand in the direction of the extension attachment.

Due to this form of construction the nozzle can be moved relatively quickly from one region to be coated into a farther removed region, for example, from one bore end face to the other.

Finally, an advantageous development of the apparatus can consist in that the sliding carriage with its guide or the pivot mounting is arranged with adjustable inclination on the stand.

It is thereby possible to adjust the extension attachment with the nozzle to any desired axial direction of the bore in question without having to align the heavy workpiece itself.

The number of turns of the apparatus to the right or to the left depends on the maximal permissible twisting of the various supply lines for gas and powder.

The apparatus according to the invention is described in detail hereinafter by reference to embodiments shown schematically in the drawing wherein.

Figure 1:
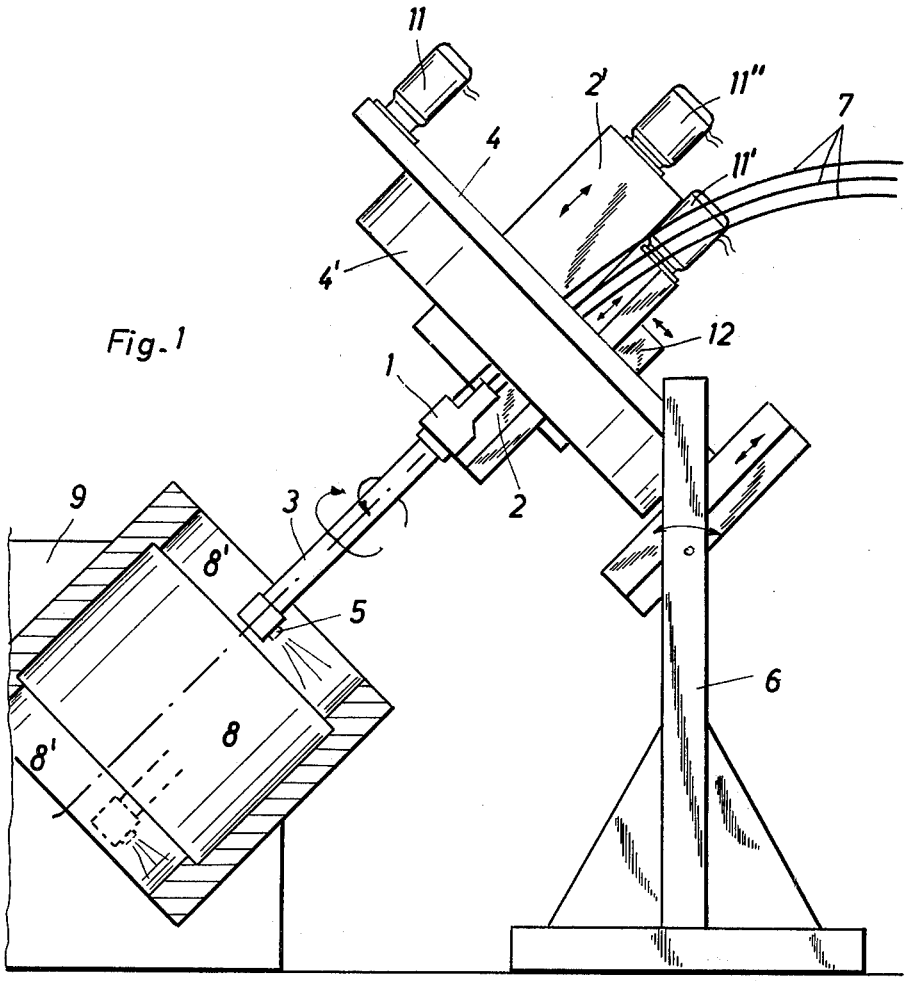
FIG. 1 is a side view of the apparatus.

In the Figures 1 denotes the flame spraying burner fastened to the front end of the sliding carriage 2, 3 designates the extension attachment with nozzle 5 whose opening is transverse to the longitudinal axis of the extension attachment and 6 denotes the apparatus stand.

7 designates the hose lines for gas and powder supply leading to the flame spraying burner 1. 8 denotes the inside bore to be coated of a large workpiece 9 which cannot be mounted rotatably.

Figure 2:
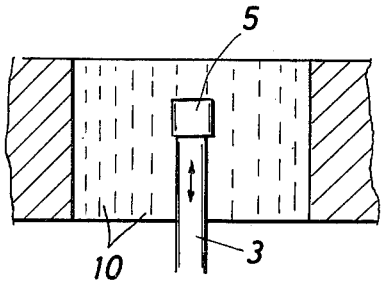
FIG. 2 is a section of a bore to be coated with a longitudinal path of the coating track.

According to FIG. 2 the bore inside face is covered with axially running tracks 10, whereby radial adjustment is carried out stepwise from track to track, optionally allowing for overlapping of the tracks, by correspondingly stepwise turning of the entire apparatus by means of the turning of the pivot mounting 4 which is provided with a correspondingly controlled drive 11. The axial advance of the nozzle 5 or of the extension attachment 3 takes place by means of the sliding carriage 2, likewise by means of a correspondingly controlled drive 11' which is shown only by way of example as an electric motor.

Figure 3:
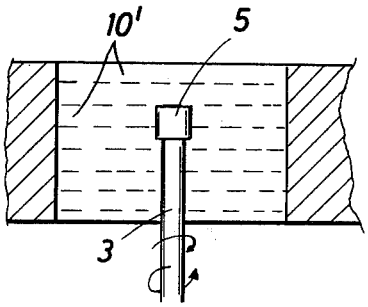
FIG. 3 is a section of a bore to be coated with a transverse path of the coating track.

According to FIG. 3 the tracks 10' can, however, also be laid radially to follow the curvature of the bore face, the pivot mounting 11 being constantly turned correspondingly slowly. The shift from one track to the next track 10' takes place stepwise, correspondingly controlled, with the sliding carriage 2.

If the end regions 8' only of a bore are to be coated in one way or the other, an additional sliding carriage 2' with drive 11'' can be provided, by which the nozzle can be adjusted in one stroke rapidly from one region to the other region 8' (marked by a broken line), without powder being sprayed.

Since with this apparatus and hard-facing method it is not necessary to provide a mounting, central to the bore centre, of the nozzle 5, the apparatus is associated with the pivot mounting 4 in such a way that it can be adjusted radially, that is, eccentrically within the pivot mounting, which takes place with a guide 12. Consequently, the desired spraying spacing of the nozzle 5 from the coating face can be adjusted. It is substantial here only that the centre of the pivot mounting 4 be adjusted at least approximately precisely to the centre of the bore 8.

Also, the entire apparatus is arranged pivotably in the direction of the arrows according to FIG. 1 and optionally also displaceably on the stand 6, so that it can from the outset be brought into the most favourable starting position in relation to the large stationary workpiece 9, from which starting position the hard-facing operation can be carried out according to FIGS. 2 or 3.

The magnitude of the turning or oscillating movements depends on the maximal permissible twisting capacity of the hose lines 7 which, however, permit a twisting of 0° to at least 360°, after which the apparatus returns stepwise or in a complete traverse to the starting position to resume application of one or more coats.

Figure 4:
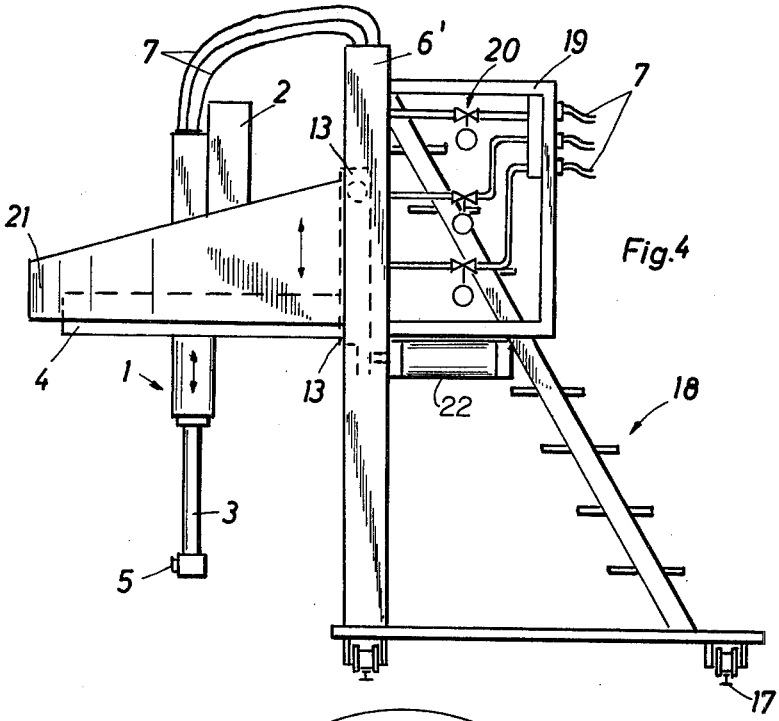
FIG. 4 is a side view of the apparatus in a rather different embodiment.
Figure 5:
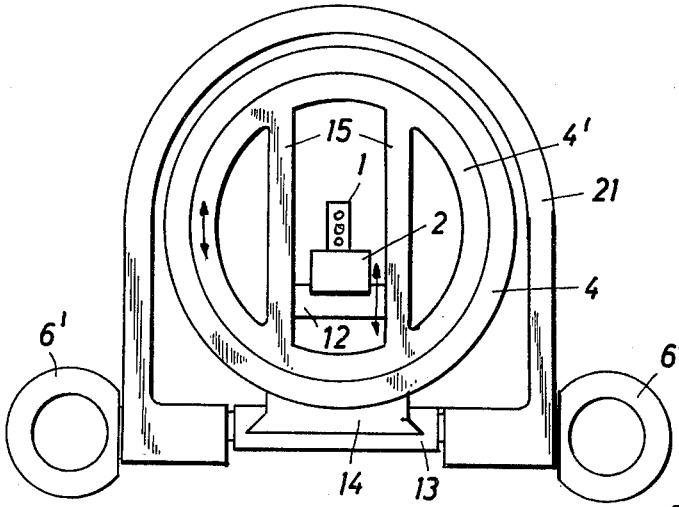
FIG. 5 is a plan view of the pivot mounting.

According to FIG. 4 the apparatus consists of a stand, movable on rails 17, with two supporting columns 6', on the one side of which is arranged a flight of stairs 18 and a retaining frame 19 for the required valves 20 and gas supply lines and on the other side of which is arranged vertically adjustably a holder 21 for the pivot mounting 4. The pivot mounting 4 is mounted with a guide piece 14 in a guide piece 13 which is mounted pivotably in the holder 21 and which can be adjusted in its inclination, for example, with an adjusting element 22. Inside the pivot mounting 4 there can be turned the bearing ring 4' which is provided with parallel guide rails 15 for the eccentric adjustment of the guide 12 on which rests axially displaceably the sliding carriage 2 for the powder flame spraying burner 1.

The drive elements for the various movements are not shown. The drives used can be electromotive, hydraulic or pneumatic drives for which a corresponding control (not shown) is provided.

We claim:

1. An apparatus for hard facing by powder flame spraying inner surfaces of bores of relatively large workpieces difficult to mount rotatably, such as Diesel engine blocks, and the like, said apparatus comprising, a stand, carriage support means pivotally mounted to said stand via holding means coupled to said stand and adapted to be adjustably inclined and to move vertically between a pair of supporting columns of said stand, a carriage mounted on said carriage support means, a burner assembly mounted to and extending transversely from said carriage, said burner assembly comprising a burner mounting having a longitudinal member extending therefrom through which powder flame spray material is fed, said member terminating into a nozzle disposed transverse to the longitudinal axis of said longitudinal member, p2 said carriage being slidably mounted and having means for sliding said carriage along the axis of said longitudinal member, said carriage in addition to being slidably mounted having means for rotating said carriage about the axis of said longitudinal member via a bearing ring, said longitudinal member and the nozzle thereof rotating with said carriage, said bearing ring having guide rails cooperably associated with an eccentrically adjustable guide means for indexing said burner assembly and carriage along the carriage support means relative to bore to be sprayed.

* * * * *